US006872434B2

(12) United States Patent
Zen

(10) Patent No.: US 6,872,434 B2
(45) Date of Patent: Mar. 29, 2005

(54) LUMBER SUBSTITUTE MEMBER

(75) Inventor: Vic De Zen, Woodbridge (CA)

(73) Assignee: Royal Group Technologies Limited, Woodbridge ( * ) Notice: Subject to any disclaimer, the term of this patent is extended or adjusted under 35 U.S.C. 154(b) by 123 days.

(21) Appl. No.: 10/277,995

(22) Filed: Oct. 23, 2002

(65) Prior Publication Data

US 2004/0081786 A1 Apr. 29, 2004

(51) Int. Cl.[7] ..... F16B 5/07; B32B 3/12; B32B 3/20; E04C 3/18; E04B 2/34

(52) U.S. Cl. ..... 428/36.9; 428/33; 428/166; 428/178; 428/188; 52/580; 52/589.1; 52/650.3; 52/793.1

(58) Field of Search ..... 428/33, 36.9, 166, 428/178, 188; 52/580, 589.1, 650.3, 793.1

(56) References Cited

U.S. PATENT DOCUMENTS 5,196,255 A * 3/1993 Cohen ..... 428/188
5,536,541 A * 7/1996 Armellini ..... 428/33
5,783,286 A * 7/1998 DiNicola ..... 428/188
5,791,047 A * 8/1998 Skalka ..... 29/897.34
5,972,475 A * 10/1999 Beekman ..... 428/167
6,237,299 B1 * 5/2001 Gortan ..... 52/693
6,415,562 B1 * 7/2002 Donaghue et al. ..... 52/177

FOREIGN PATENT DOCUMENTS

CA 2309127 A1 * 11/2001 ..... E04C/3/28

* cited by examiner

*Primary Examiner*—Harold Pyon
*Assistant Examiner*—Chris Bruenjes

(57) ABSTRACT

A lumber substitute product formed by two elongated plastic members which are secured together and configured to have the external cross sectional shape of the product for which it is a substitute while providing an internal longitudinal channel adjacent each in which reinforcing member is mounted.

16 Claims, 3 Drawing Sheets

LUMBER SUBSTITUTE MEMBER

FIELD OF THE INVENTION

This invention relates to lumber substitute products which can beneficially be substituted for conventional lumber such as two by fours, two by sixes, two by eights and other standard lumber products.

With the ever increasing demand for lumber products for housing and other building projects, the availability of such lumber products is becoming limited and their cost has increased significantly adding a substantial amount to, for instance, the cost of a house.

Moreover, conventional lumber inherently is subject to deterioration with time and exposure to the elements including warping, rotting, splintering, cracking, and destruction by ants, wasps, and other insects.

It is the object of this invention to provide a substitute lumber product manufactured from synthetic plastic material which will have a significantly lower cost yet with significantly increased strength and loading capability than conventional lumber.

Further, it is an object to provide such substitute lumber products that are resistant to weathering and attack by insects.

It is still a further object to provide such substitute lumber products which can be sawn, nailed and drilled as readily as conventional lumber.

These and other objects and features will become apparent from the detailed description of the invention.

BACKGROUND OF THE INVENTION

While synthetic plastic material has been used in many applications where wood previously was used, these have involved special profiles not acceptable as true lumber substitute products.

For instance, in the Anderson Patent EP O 586 213 A 1, the profiles for window frames were extruded from a composite material involving sawdust and a polymeric material.

Again, in U.S. Pat. No. 6,412,227, there is disclosed the use of a composite material to mold the frame members for doors and the like.

Published Canadian Application Serial No. 2,309,127 discloses a proposed member for use as a lumber substitute which member has wires embedded in a body of composite plastic material which has grooved exterior surfaces to enable such members to be fitted together with the lands between the grooves of one member fitted into the grooves of the other member and vice versa.

All such aforesaid members are one piece members requiring a substantial volume and weight of plastic synthetic material and are not acceptable as realistic simple lumber substitutes.

SUMMARY OF THE INVENTION

According to the present invention, the lumber substitute product is constituted by two elongated mating synthetic plastic members secured together to produce transverse their length the external rectangular shape and width and thickness dimensions of the lumber member for which said product is a substitute and to produce a longitudinal channel adjacent each edge of said product which extends the thickness of said product. Mounted in said channels are longitudinally extending reinforcing members.

According to the preferred form of the invention, the mating plastic members are of identical configuration.

Again, according to the preferred form of the invention, the mating members are molded composite plastic members.

Again, according to the preferred form of the invention, the mating members are secured together by mechanical fasteners and preferably include mechanical fasteners which penetrate the reinforcing members.

Again, according to the preferred form of the invention, the reinforcing members are metal strips formed into a square wave form.

Again, according to the preferred form of the invention, the mating plastic members define longitudinal cavities therebetween spaced inwardly from said channels.

In a particularly preferred form of the invention, the matted synthetic plastic members are identical and each has a transverse wall having a thickness less that one-half of the thickness of the product and a width substantially equal to the width of the product. The transverse wall of each member has a generally planar outer side presented to the exterior of the product and an inner side presented to the interior of the product, and at one longitudinal edge the transverse wall has an edge wall extending right angularly from its planar face a distance equal to the thickness of the product. The transverse wall further has a first longitudinal relatively thick flange or leg projecting from the inner side thereof spaced close to and extending parallel to the edge wall. The inner side of the transverse wall is recessed between the first leg and the edge wall. The other longitudinal edge of the transverse wall opposite to the edge wall is reduced in thickness on its inner side over a narrow band along its length to provide on the inner side thereof a longitudinal shoulder spaced from the edge a distance equal to the spacing of the first leg from the edge wall.

Again, the transverse wall has a second longitudinal relatively thick flange or leg projecting from the inner side extending parallel to and spaced laterally from the shoulder a distance equal to the thickness of the first leg, the arrangement being such that when the mated members oppose each other with the edge wall of one of the members abutting the edge with the reduced thickness of the other member and vice versa and with the first leg of one member abutting the shoulder of the other member and vice versa, there is provided a longitudinal channel adjacent each edge of the product. Further, the arrangement is such that the second leg of one member is overlapped with the first leg of the other member and vice versa with the edges of the legs of each member abutting the inner side of the opposing member. The reinforcing members are mounted in the aforesaid channels to provide strength against deflection, twisting and to increase loading capability.

Again, according to the preferred form of the invention, the mating members are formed from a synthetic composite plastic material comprising particles of waste or filter material bound together by a thermoplastic binder of recycled plastic material. A preferred material is one including an effective amount of high melting point polymer fiber material and a sufficient amount of fiber coating plastic material to coat and bind the fiber material together. The fiber coating plastic material is one that has a melting point substantially below the melting point of the fiber material.

These and other features of the invention will become apparent from the following detailed description taken in conjunction with the accompanying drawings in which

DETAILED DESCRIPTION ACCORDING TO THE PREFERRED EMBODIMENTS OF THE PRESENT INVENTION

Figure 1:
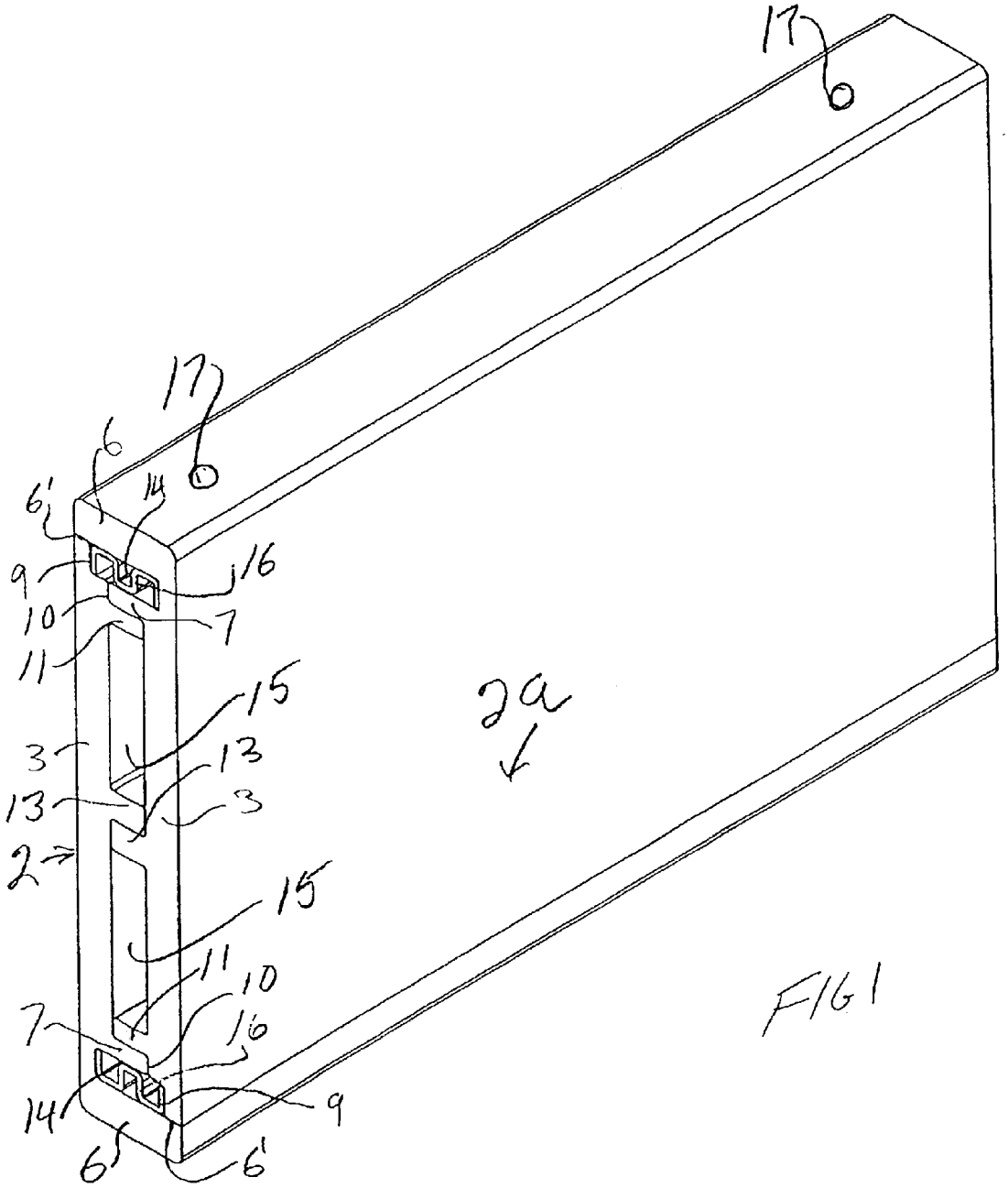
FIG. 1 is a perspective view of a length of lumber substitute product embodying the preferred form of the invention, the lumber substitute product having a nominal value of a conventional two by eight.
Figure 2:
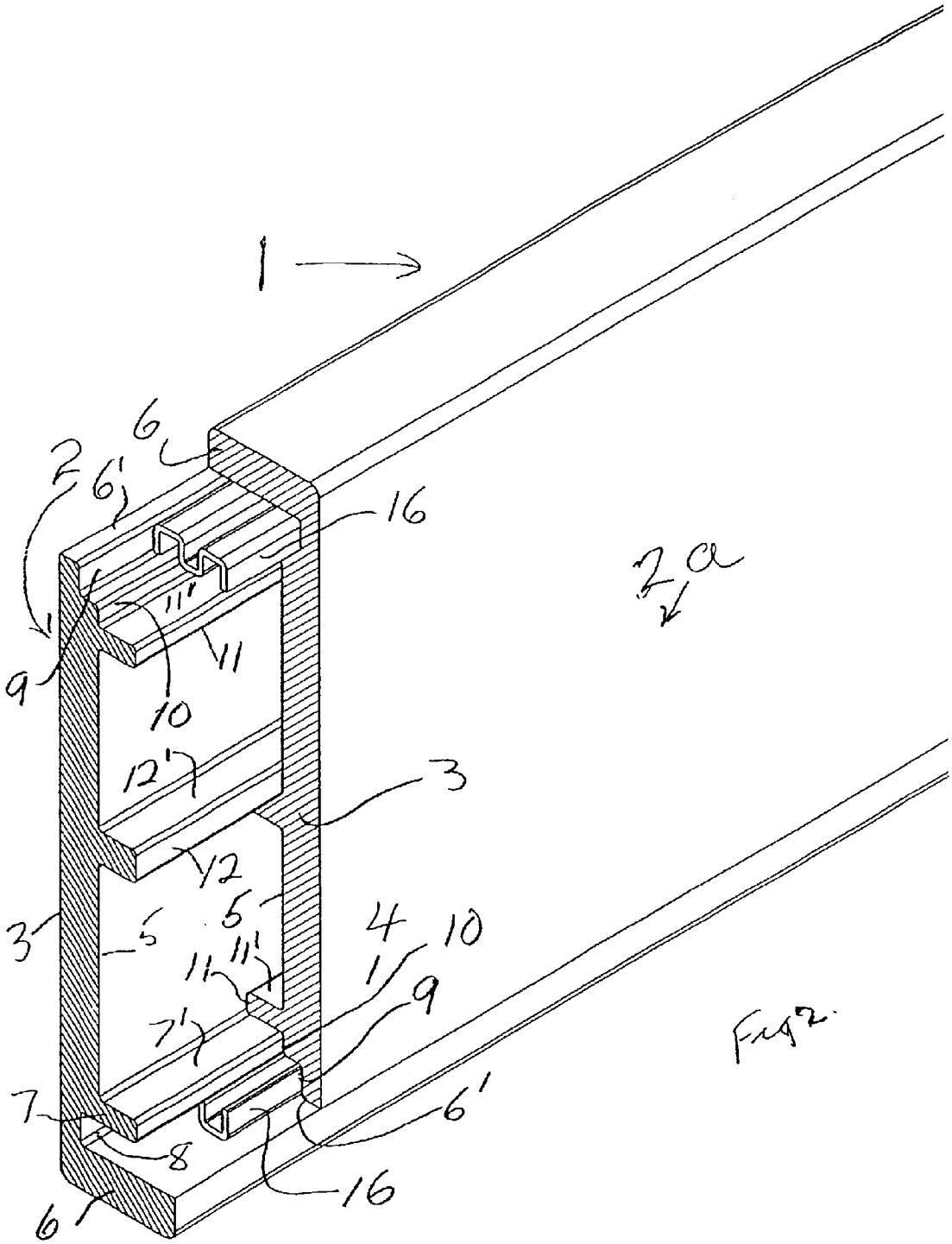
FIG. 2 is a view similar to FIG. 1 but partly broken away to illustrate how the two identical members mate to provide the exterior shape and dimensions of the lumber for which the product is a substitute and showing how the channels in which the reinforcing inserts are mounted are formed.
Figure 3:
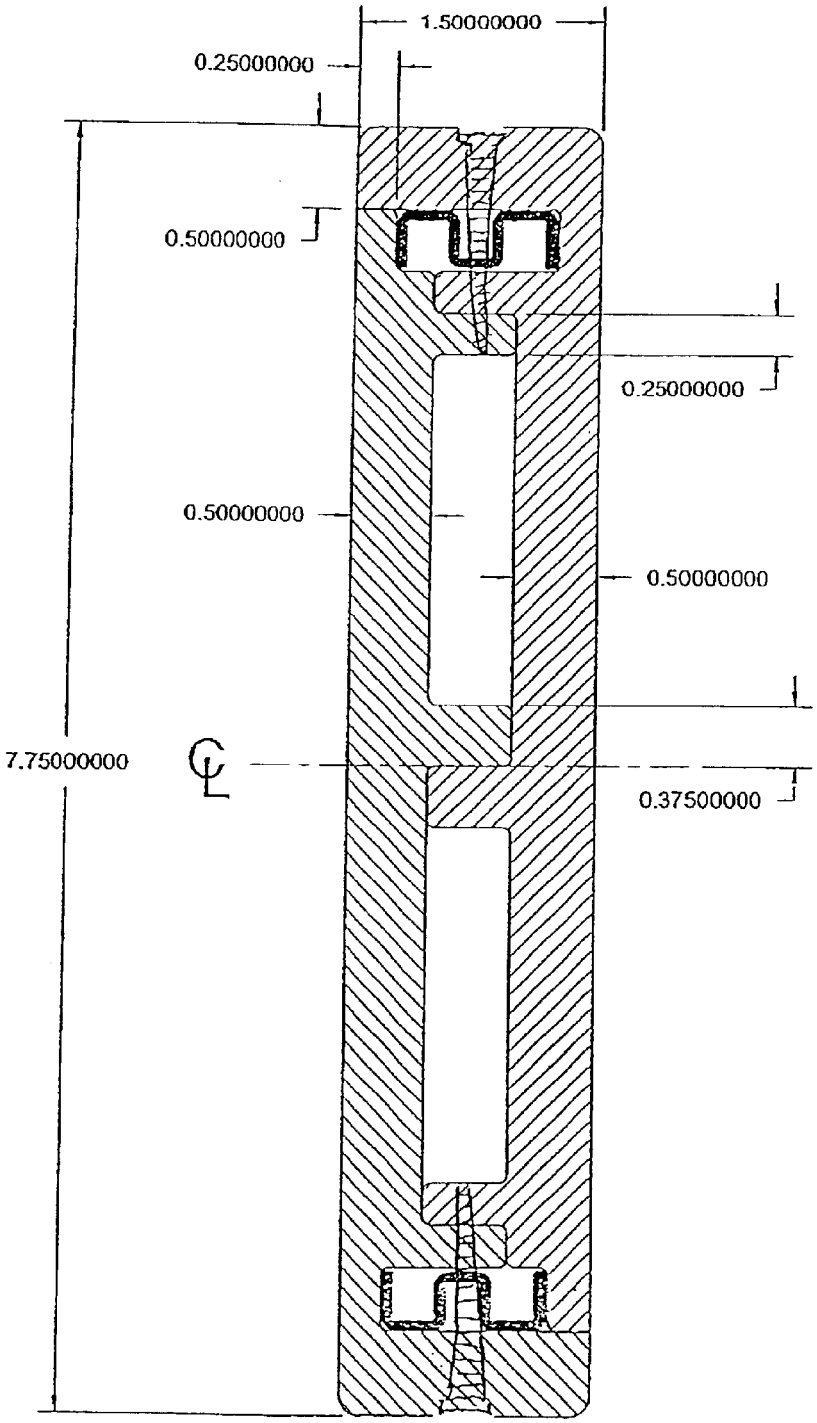
FIG. 3 is a vertical sectional view of the lumber substitute product of FIGS. 1 and 2 showing one arrangement of using screws to secure the mating members in mated relation.
Figure 4:
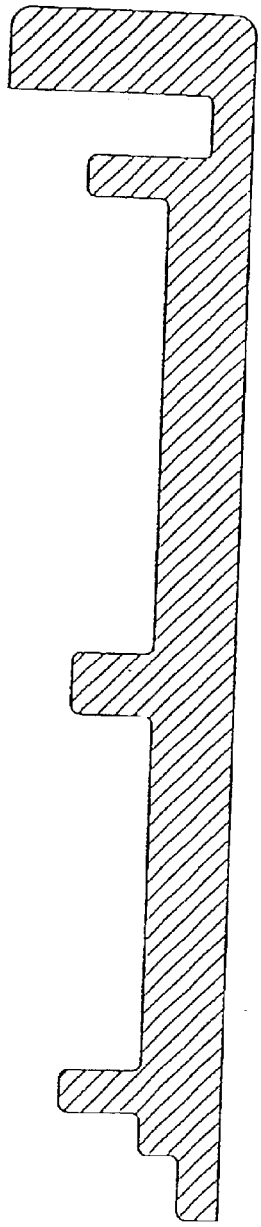
FIG. 4 is a vertical sectional view of one of the mating members.

With reference to FIGS. 1, 2 and 3, the lumber substitute product depicted as an example and generally designated at 1 is intended to be used as a substitute for a conventional length of lumber having a nominal cross section of a 2×8 (the actual dimensions normally being 1 ½ inches by 7 ¾ inches).

As illustrated, in its preferred embodiment, the lumber substitute product 1 comprises a pair of elongated identical mating members designated 2 and 2*a* formed of suitable plastic material which when mated together as illustrated in FIGS. 1, 2 and 3 define the external shape and dimensions of width and thickness of the lumber for which the product is a substitute, i.e. a piece of lumber having a nominal value of a 2×8.

In describing the identical members 2 and 2*a*, the same references numerals are given to the identical parts for ease of understanding.

Each of the identical mating members 2 and 2*a* has a wall 3 defining the width of the product 1, i.e. nominally 8 inches. Walls 3 each has a generally planar outer side 4 presented to the exterior of the product.

The thickness of the wall 3 is less than half the depth or thickness of the lumber substitute product 1, i.e. nominally 2 inches, and preferably ⅓ rd of such thickness.

The inner side 5 of each of the walls 3 is presented to the interior of the product 1 and has at one longitudinal edge an edge wall 6 extending right angularly from its planar face 4 a distance equal to the thickness of the product 1.

Each of the transverse walls 3 has a first relatively thick longitudinally extending flange or leg 7 whose faces 7' are planar projecting from the inner side 5 thereof inwardly of said edge walls 6 and extending parallel thereto. Between the edge wall 6 and the flange or leg 7, the inner side 5 of the wall 3 is recessed as at 8.

The edge 6' of each of the transverse walls 3 opposite to the edge wall 6 is reduced in thickness on the inner side thereof along its length as at 9 to define one side of an abutment shoulder 10 spaced from the edge 6' a distance equal to the spacing of the flange or leg 7 from the edge wall 6.

The inner side 5 of each of the walls 3 has a second relatively thick longitudinal flange or leg 11 similar to leg 7. Again the faces 11' of leg 11 are planar. Leg 11 extends parallel to and spaced inwardly from the thinned edge portion 9 a distance equal to the thickness of the first leg 7 to define the other side of the shoulder 10.

Projecting from the inner side 5 of each of the walls 3 is a third longitudinal flange or leg 12 which is thicker than the legs 7 and 11.

As in the case of legs 7 and 11, the faces 12' of leg 12 are planar and the leg extends parallel to the edge wall 6 and the other legs 7 and 11.

The longitudinal planar face 12' of the leg 12 closest to the edge wall 3 lies on a plane 13—13 through the longitudinal center line of the product 1.

The arrangement is such that when the mating members 2 and 2*a* are brought together face to face with the edge wall 6 of one of the members abutting the reduced edge portion 9 of the other member and vice versa, they form channels 14 defined by the edge walls 6 and the first legs 7 abutting the shoulders 10. In addition, the second legs 11 of the members 2 and 2*a* overlap the first legs 7 with the ends of the legs contacting the inner side or surface 5 of the opposing member.

The third legs 12 of the opposing members overlap each other and contact the inner surface 5 of the opposing member defining the hollow rectangular spaces 15. In each case, the ends of the overlapped legs 7, 11 and 12 abut against the opposing member and preclude inward collapsing of the product 1 under load.

Mounted in the channels 14 are reinforcing members 16 preferably steel members formed in a square wave shape.

As illustrated in FIG. 3, the mated members 2 and 2*a* are secured together by means of screws 17 which pass through the metal reinforcement 16 and through the overlapped first and second legs of the opposing members 2 and 2*a*.

It will be understood that the mated components may be secured in the mated relationship in many other ways preferably by mechanical fasteners such as nails or screws which can, for example, be driven through the wall 3 of component 2 into the legs 7, 11 and 12 of component 2*a* and vice versa. The mating members could also be glued together although the gluing process is somewhat labour intensive.

As mentioned, the members 2 and 2*a* are formed from a suitable plastic material. Preferably such components are injection molded from a composite plastic material as described above. Such composite plastic materials provide a very low cost material yet enable the molding of the components into low cost yet precisely formed high strength members.

It will be understood that while a 2×8 has been particularly shown and described, the invention is equally applicable to other lumber substitutes, eg. 2×4's, 2×6's, 2×10's etc, which involve only changing the width of the transverse walls 3 of the members 2 and 2*a* while maintaining the same relative relationships between the legs 7, 11 and 12 and the members edge walls 6 and edges 6'.

While preferred forms of the invention has been particularly described and illustrated, it will be apparent that variations in detail may be made without departing from the scope of the appended claims.

The embodiments of the invention in which an exclusive property or privilege is claimed are defined as follows:

1. A product to form a substitute product for lumber comprising first and second elongated molded plastic members adapted to be secured together to provide on securement transverse their length the external rectangular shape and dimensions of the lumber, selected from one of 2×4, a 2×6, or a 2×8, 2×10 or a 2×12, for which said product is to be a substitute, means securing said members together to form said product, said plastic members being molded to provide a longitudinal internal channel adjacent each edge of said product extending transversely of the thickness of the product and to provide spaced parallel side walls extending between said edge channels, each said side wall having a thickness of the order of ⅓ the thickness of said product, said side walls having projecting legs that extend across the space between said side walls to abut the wall opposite to the one from which they extend with the legs from opposite walls overlapping each other, and an elongated reinforcing member mounted in each of said channels.

2. A lumber substitute product as claimed in claim 1 in which said first and second members are identical.

3. A lumber substitute product as claimed in claim 1 or 2 in which said plastic members are injection molded from a composite plastic material.

4. A lumber substitute product as claimed in claim 1, 2 or 3 in which said plastic members are secured together by mechanical fasteners.

5. A lumber substitute product as claimed in claim 1, 2 or 3 in which said plastic members are glued together.

6. A lumber substitute product as claimed in claim 1, 2 or 3 in which said reinforcing members are steel members.

7. A lumber substitute product as claimed in claim 1, 2 or 3 in which said reinforcing members are steel members having a square wave shape.

8. A lumber substitute product comprising a pair of elongated identical mating plastic members secured together in mated relation, said mated members defining transverse their length the external shape and dimensions of width and thickness of the lumber for which said product is a substitute, each of said mated members having a transverse wall having a thickness less than one half of the thickness of said product and a width extending substantially the width of said product, said transverse wall of each member having a generally planar outer side presented to the exterior of said product and an inner side presented to the interior of said product and having at one longitudinal edge an edge wall extending right angularly from said planar face a distance equal to the thickness of said product, said transverse wall having a first longitudinal leg projecting from the inner side thereof spaced close to and extending parallel to said edge wall with the inner side of said transverse wall being recessed between said first leg and said edge wall, said transverse wall being reduced in thickness along its length at its other longitudinal edge to provide on the inner side thereof one side of a longitudinal shoulder spaced from said other edge a distance equal to the spacing of said first leg from said edge wall, said transverse wall having a second longitudinal leg projecting from said inner side extending parallel to and spaced laterally from said one shoulder side a distance equal to the thickness of said first leg to define the other shoulder side said mated members being secured together with the edge wall of one of said members overlying and abutting the edge of the other member having the reduced thickness and vice versa and with the first leg of one of said members abutting the shoulder of the other member and vice versa to provide a longitudinal channel adjacent each edge of said product and with said second leg of each member overlapped with said first leg of the other member and abutting the inner side of the opposing member, and a longitudinal reinforcing member mounted in each of said channels.

9. A lumber substitute as claimed in claim 8 in which said transverse wall of each of said members has an integral third longitudinal leg projecting from the inner side thereof, said third leg being parallel to said respective edge wall and spaced from said respective edge wall such that the side of said leg closest to said respective edge wall lies in a plane through the longitudinal center line of said product.

10. A lumber substitute as claimed in claim 9 in which said first and second lags have equal thickness which is less than the thickness of said third leg.

11. A lumber substitute as claimed in claim 8, 9 or 10 in which the thickness of said transverse wall of each of said members is one-third the thickness of said product.

12. A lumber substitute as claimed in claim 8, 9 or 10 in which each of said members is formed of a composite plastic material.

13. A lumber substitute as claimed in claim 8, 9 or 10 in which each of said members is a molded member molded of composite plastic material.

14. A lumber substitute as claimed in claim 8, 9 or 10 in which each of said members is an injected molded member molded from a composite plastic material comprising a filler material bound together by recycled plastic material.

15. A lumber substitute as claimed in claim 8, 9 or 10 in which said reinforcing members are metal members.

16. A lumber substitute as claimed in claim 8, 9 or 10 in which said reinforcing are steel strips folded into a square wave form.

* * * * *